US006646517B2

(12) United States Patent
Shimmura et al.

(10) Patent No.: US 6,646,517 B2
(45) **Date of Patent: *Nov. 11, 2003**

(54) NONRECIPROCAL CIRCUIT DEVICE AND COMMUNICATION DEVICE HAVING ONLY TWO PORTS

(75) Inventors: Satoru Shimmura, Kanazawa (JP); Makoto Kawashima, Ishikawa-ken (JP); Seigo Hino, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/053,775

(22) Filed: Jan. 22, 2002

(65) Prior Publication Data

US 2002/0097103 A1 Jul. 25, 2002

(30) Foreign Application Priority Data

Jan. 24, 2001 (JP) ..... 2001-016127
Nov. 16, 2001 (JP) ..... 2001-351947

(51) Int. Cl.[7] ..... H01P 1/36
(52) U.S. Cl. ..... 333/24.2; 333/1.1

(58) Field of Search ..... 333/1.1, 24.2

(56) References Cited

U.S. PATENT DOCUMENTS 3,614,675 A * 10/1971 Konishi ..... 333/24.2
3,906,404 A * 9/1975 Dixon, Jr. ..... 333/24.2 X
5,628,057 A * 5/1997 Phillips et al. ..... 333/26 X
5,638,033 A * 6/1997 Walker et al. ..... 333/1.1

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

A nonreciprocal circuit device which can be connected to a balanced circuit without going through a balun, and a communication device which includes the nonreciprocal circuit device. An isolator generally includes a circuit board, a lower metal case, a center electrode assembly, an upper metal case, a permanent magnet, a resistor, and matching capacitors. The circuit board comprises an insulating substrate, such as a glass epoxy substrate or a ferrite substrate, on which are formed an unbalanced input terminal, balanced output terminals (i.e., differential output terminals), a grounding terminal, and a half-wave line which interconnects the balanced output terminals.

8 Claims, 8 Drawing Sheets

NONRECIPROCAL CIRCUIT DEVICE AND COMMUNICATION DEVICE HAVING ONLY TWO PORTS

BACKGROUND OF THE INVENTION

1. Field of the Invention

The present invention relates to a nonreciprocal circuit device, and, more particularly, to a nonreciprocal circuit device such as an isolator for use in the microwave band, and to a communication device.

2. Description of the Related Art

FIG. 13 is an electrical-circuit block diagram of an RF portion of a conventional portable phone 1. In FIG. 13, reference numeral 2 denotes an antenna element. Reference numeral 3 denotes a duplexer Reference numerals 4 and 6 each denote a power amplifier on the transmission side. Reference numeral 5 denotes an interstage band-pass filter on the transmission side. Reference numeral 7 denotes a mixer on the transmission side. Reference numeral 8 denotes a low-noise amplifier on the receiving side. Reference numeral 9 denotes an interstage band-pass filter on the receiving side. Reference numeral 10 denotes a mixer on the receiving side. Reference numeral 11 denotes an isolator. Reference numeral 12 denotes a voltage-controlled oscillator (VCO). Reference numeral 13 denotes a local band-pass filter.

Generally, the isolator 11 is disposed between the voltage-controlled oscillator 12 and the mixers 7 and 10 on the transmission and receiving sides in order to achieve isolation between the voltage-controlled oscillator 12 and the mixers 7 and 10 on the transmission and receiving sides, so that signals reflected from the mixers on the transmission and receiving sides are not returned to the voltage-controlled oscillator. Instead of the isolator 11, a buffer amplifier is sometimes used. However, since the isolator 11 of a nonreciprocal circuit device does not require power, the battery life is not affected by the isolator, so the isolator 11 has the advantage that the standby time and the telephone conversation time of the portable phone 1 can be increased.

As there has been a demand for smaller portable phones and to achieve cost reduction in recent years, ICs incorporating the mixer 7 on the transmission side and the mixer 10 on the receiving side (which are balanced input/output circuits) have become more and more common. However, the input/output ports of a conventional isolator 11 are both unbalanced-type ports. Therefore, in order to electrically connect to the isolator 11 the balanced-type input/output ports of an IC in which a mixer is incorporated, it is necessary to convert a parallel signal of the IC to a single ended signal by using a balun. For this reason, the number of components is increased, and the number of connection points is increased, presenting problems of radiation, resistive losses, and greater mounting area and failure rate, for example.

SUMMARY OF THE INVENTION

To address these problems, the present invention provides a nonreciprocal circuit device which can be connected to a balanced circuit without going through a balun, and a communication device.

The nonreciprocal circuit device according to the present invention may have two ports, wherein at least one of the two ports is a balanced-type port. For example, there are cases in which only the input port is a balanced-type port, or only the output port is a balanced-type port, or both the input port and the output port are balanced-type ports.

More specifically, the nonreciprocal circuit device may comprise a center electrode assembly formed of a ferrite and two center electrodes, a permanent magnet for applying a DC magnetic-field to the ferrite, and a metal case for housing the center electrode assembly and the permanent magnet. The balanced-type port is formed of a pair of terminals which are electrically connected respectively to the two ends of a line that is substantially a half-wave in length at an operating frequency, and one of the pair of terminals is connected to one of the center electrodes. Furthermore, the balanced-type port is formed of a pair of terminals which are electrically connected to both ends of one of the center electrodes via a matching capacitor.

The nonreciprocal circuit device having the above construction can be connected to a balanced circuit without going through a balun.

The communication device according to the present invention comprises a nonreciprocal circuit device having the above-described features, and therefore, high reliability can be obtained.

Further features and advantages of the present invention will become apparent from the following description of embodiments of the invention with reference to the attached drawings.

DESCRIPTION OF EMBODIMENTS OF THE INVENTION

Figure 1:
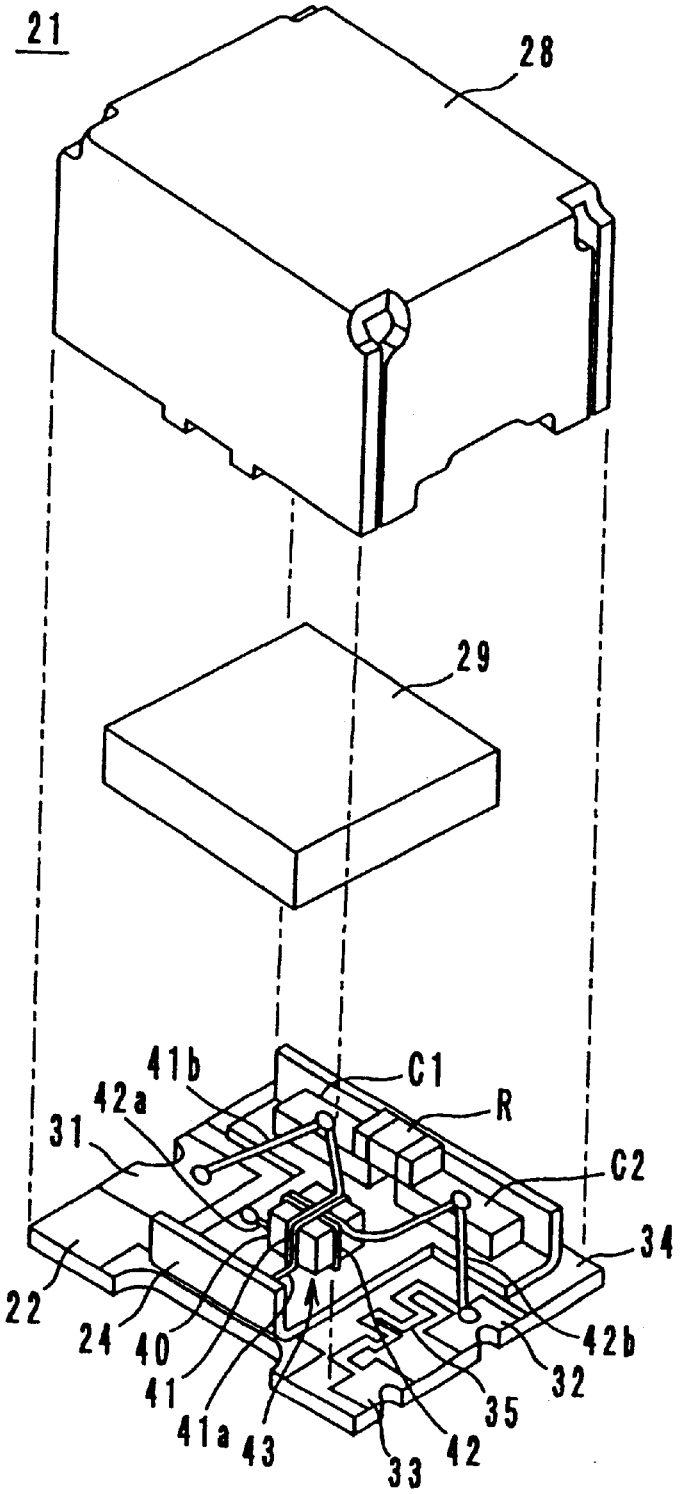
FIG. 1 is an exploded perspective view showing a first embodiment of a nonreciprocal circuit device according to the present invention.

Embodiments of a nonreciprocal circuit device and a communication device according to the present invention will be described below with reference to the attached drawings. In each embodiment, a description is given by using, as a nonreciprocal circuit device, a lumped-constant-type isolator as an example. Components and portions which are the same in the several embodiments are given the same reference numerals, and duplicated descriptions are omitted.

Figure 2:
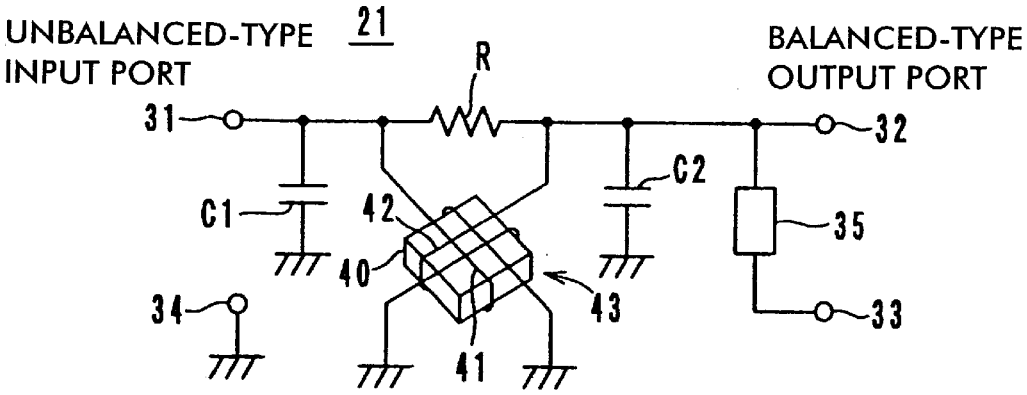
FIG. 2 is an electrical-equivalent circuit diagram of the nonreciprocal circuit device shown in FIG. 1.
Figure 3:
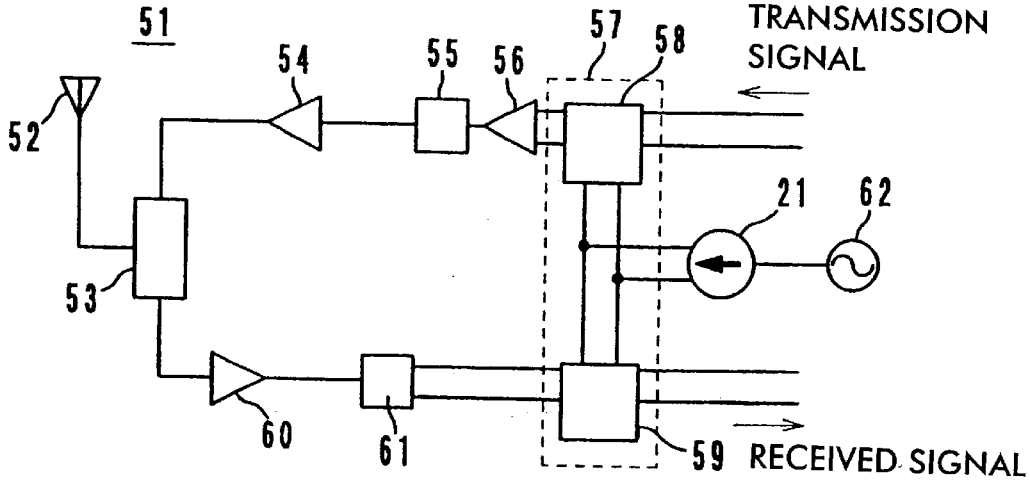
FIG. 3 is an electrical block diagram of a communication device comprising the nonreciprocal circuit device shown in FIG. 1.

[First Embodiment, FIGS. 1 to 3]

As shown in FIG. 1, an isolator 21 generally comprises a circuit board 22, a lower metal case 24, a center electrode assembly 43, an upper metal case 28, a permanent magnet 29, a resistor R, and matching capacitors C1 and C2.

The center electrode assembly 43 comprises a rectangular microwave ferrite 40, and center electrodes 41 and 42 formed by winding two conductors (a copper wire, a silver wire, etc.) covered with an insulator around the surface of the ferrite 40, the center electrodes 41 and 42 being made to cross each other so that their intersection angle is substantially 90 degrees. The center electrode assembly 43 is fixed to the top surface of the lower metal case 24 with a bonding agent. Furthermore, the ends 41*a* and 42*a* of the center electrodes 41 and 42, respectively, are connected to the lower metal case 24 by a method such as soldering, and are thus grounded.

On the circuit board 22, an unbalanced-type input terminal 31, balanced-type output terminals (i.e., differential output terminals) 32 and 33, a grounding terminal 34, and a half-wave line 35 are formed on an insulating substrate, such as a glass epoxy substrate or a ferrite substrate. The unbalanced-type input terminal 31 is exposed on the left side of the circuit board 22 as seen in FIG. 1, and the pair of balanced-type output terminals 32 and 33 are exposed on the right side of the circuit board 22. The grounding terminal 34 extends across the back of the circuit board 22 as seen in FIG. 1, and end portions thereof are exposed on the left and right sides of the circuit board 22. A meandering half-wave line 35 is electrically connected between the balanced-type output terminals 32 and 33 so that the phase difference at an intended operating frequency is 180 degrees. As a result of using the half-wave line 35, when the operating frequency of the isolator 21 is desired to be changed, the half-wave line 35 having a desired operating frequency can be formed simply by forming an electrode pattern of a predetermined length on the circuit board 22 according to the operating frequency. Furthermore, by changing the dielectric constant of the circuit board 22, the size of the half-wave line 35 can be reduced even more.

Above the grounding terminal 34 of the circuit board 22, the lower metal case 24 is soldered. Furthermore, on the top surface of the lower metal case 24, matching capacitors C1 and C2 and a resistor R are mounted. That is, in each of the matching capacitors C1 and C2, a capacitor electrode on the cold side is soldered to the lower metal case 24. One side of the resistor R is soldered to a capacitor electrode on the hot side of the matching capacitor C1, and the other side is soldered to a capacitor electrode on the hot side of the matching capacitor C2. Furthermore, the other end 41*b* of the center electrode 41 is soldered to the capacitor electrode on the hot side of the matching capacitor C1, and, thereafter, the other end 41*b* is soldered to the unbalanced-type input terminal 31. Similarly, the other end 42*b* of the center electrode 42 is soldered to the capacitor electrode on the hot side of the matching capacitor C2, and, thereafter, the other end 42*b* is soldered to the balanced-type output terminal 32.

Further, the permanent magnet 29 is mounted on the ceiling of the upper metal case 28 by a method such as an adhesive, and thereafter, the upper metal case 28 is placed on the circuit board 22. The permanent magnet 29 applies a DC magnetic-field to the ferrite 40 of the center electrode assembly 43. The lower metal case 24 and the upper metal case 28 are bonded together to form a metal case, forming a magnetic circuit.

FIG. 2 is an electrical-equivalent circuit diagram of the isolator 21. FIG. 3 is an electrical block diagram in a case where the isolator 21 is incorporated in the RF portion of a portable phone 51. In FIG. 3, reference numeral 52 denotes an antenna element. Reference numeral 53 denotes a duplexer. Reference numerals 54 and 56 each denote a power amplifier on the transmission side. Reference numeral 55 denotes an interstage band-pass filter on the transmission side. Reference numeral 57 denotes an IC in which a modulator 58 and a demodulator 59 are incorporated. Reference numeral 60 denotes a low-noise amplifier on the receiving side. Reference numeral 61 denotes an interstage band-pass filter on the receiving side. Reference numeral 62 denotes a voltage-controlled oscillator (VCO).

Here, the input/output terminals of the IC 57 are of a balanced type, and parts to be connected to the IC 57 need to be provided with balanced-type terminals. The input port of the isolator 21 is formed by the unbalanced-type input terminal 31, and the output port is formed by the balanced-type output terminals 32 and 33. Therefore, the unbalanced-type input terminal 31 of the isolator 21 can be electrically connected to the voltage-controlled oscillator 62, and the balanced-type output terminals 32 and 33 can be electrically connected to the IC 57.

That is, since this isolator 21 can output signals having a phase difference of 180 degrees at the same amplitude from the balanced-type output terminals 32 and 33, the isolator 21 can be connected to the balanced-type input terminals of the IC 57 without going through a balun. Therefore, the number of components is decreased, and the area of the circuit board 22 can be decreased. Furthermore, since the balun can be omitted, it is possible to obtain a small and low-cost portable phone 51 having a low insertion loss and low unwanted radiation.

Figure 4:
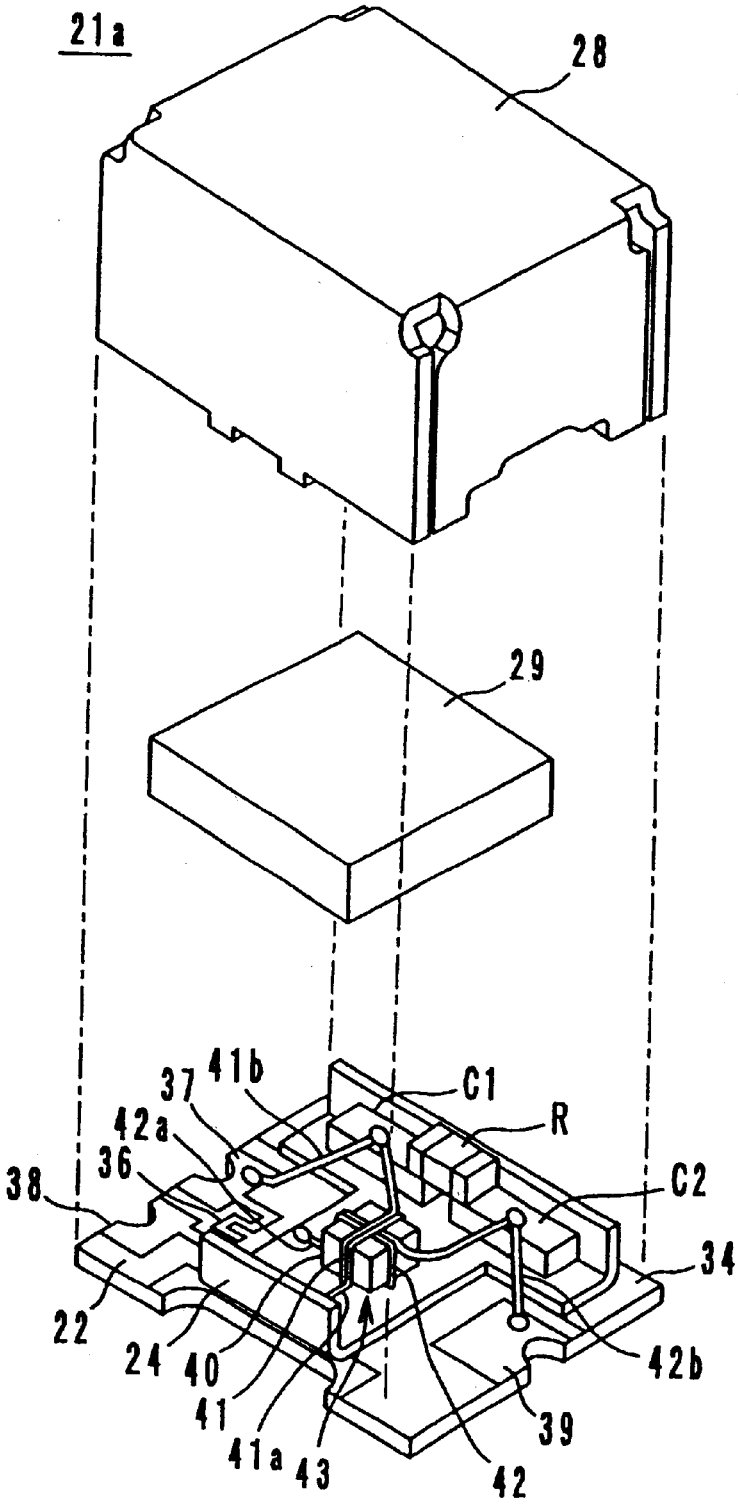
FIG. 4 is an exploded perspective view showing a second embodiment of a nonreciprocal circuit device according to the present invention.
Figure 5:
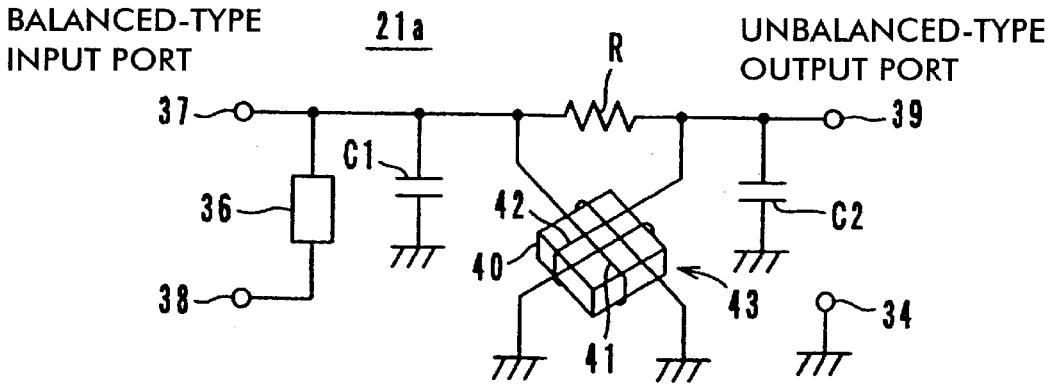
FIG. 5 is an electrical-equivalent circuit diagram of the nonreciprocal circuit device shown in FIG. 4.
Figure 6:
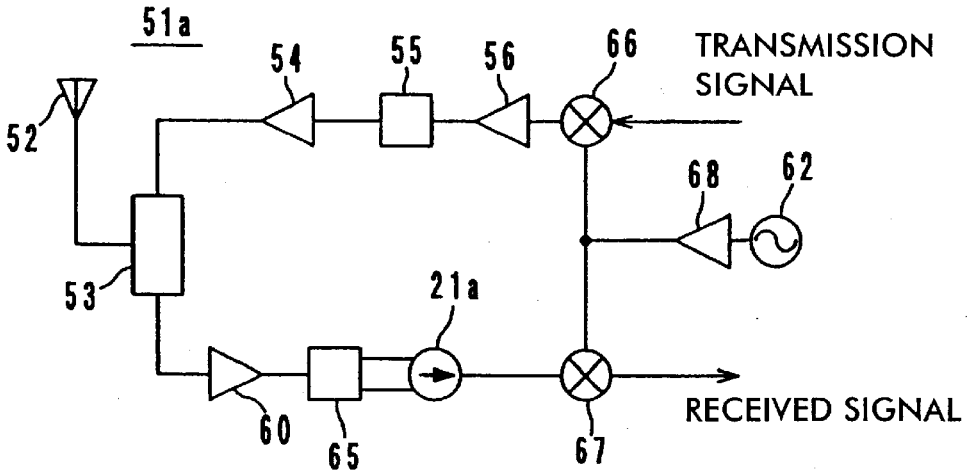
FIG. 6 is an electrical block diagram of a communication device comprising the nonreciprocal circuit device shown in FIG. 4.

[Second Embodiment, FIGS. 4 to 6]

As shown in FIGS. 4 and 5, in the isolator 21*a* of the second embodiment, the input port is formed by a pair of balanced-type input terminals 37 and 38, and the output port is formed by an unbalanced-type output terminal 39.

The balanced-type input terminals 37 and 38, the grounding terminal 34, and the half-wave line 36 are formed on the circuit board 22. The balanced-type input terminals 37 and 38 are exposed on the left side of the circuit board 22, and the unbalanced-type output terminal 39 is exposed on the right side of the circuit board 22. The meandering half-wave line 36 is electrically connected between the balanced-type input terminals 37 and 38 so that the phase difference at an intended operating frequency is 180 degrees.

Then, the end portion 41*b* of the center electrode 41 of the center electrode assembly 43 is soldered to the capacitor electrode on the hot side of the matching capacitor C1, and, thereafter, the end portion 41*b* is soldered to the balanced-type input terminal 37. Similarly, the end portion 42*b* of the center electrode 42 is soldered to the capacitor electrode on the hot side of the matching capacitor C2, and, thereafter, the end portion 42*b* is soldered to the unbalanced-type output terminal 39.

FIG. 6 is an electrical-circuit block diagram showing a case where the isolator 21*a* is incorporated in the RF portion of the portable phone 51*a*. In FIG. 6, reference numeral 52 denotes an antenna element. Reference numeral 53 denotes a duplexer. Reference numerals 54 and 56 each denote a power amplifier on the transmission side. Reference numeral 55 denotes an interstage band-pass filter on the transmission side. Reference numeral 66 denotes a mixer on the transmission side. Reference numeral 60 denotes a low-noise amplifier on the receiving side. Reference numeral 65 denotes an interstage band-pass filter on the receiving side. Reference numeral 67 denotes a mixer on the receiving side. Reference numeral 68 denotes a buffer amplifier. Reference numeral 62 denotes a voltage-controlled oscillator.

In recent years, in modulation/demodulation circuits of a portable phone, a direct conversion modulation method has been increasingly used, for the reason that, since an IF filter is not necessary, its size can be reduced. A circuit shown in FIG. 6 is an example thereof. In the circuit shown in FIG. 6, since the transmission frequency of the voltage-controlled oscillator 62 is very close to the RF frequency of the transmission system and the receiving system, it is difficult to remove stray signals of these frequencies with a filter. For this reason, the signal which enters the receiving system from the antenna element 52 and a stray signal coming from the voltage-controlled oscillator 62 enter the low-noise amplifier 60 at the same time. In this case, electromagnetic interference occurs inside the low-noise amplifier 60, and a problem arises in that a signal to be received cannot be received satisfactorily.

Therefore, as shown in FIG. 6, by inserting the isolator 21*a* on the receiving side, a stray signal coming from the voltage-controlled oscillator 62 is attenuated by the isolator 21*a* in order to prevent an occurrence of electromagnetic interference. In this arrangement, a Surface-Acoustic-Wave filter having a balanced-type output terminal is sometimes used as the band-pass filter 65. The reason for this is that a filter having a balanced-type output terminal has superior noise resistance. Therefore, the balanced-type input terminals 37 and 38 of the isolator 21*a* are electrically connected to the Surface-Acoustic-Wave band-pass filter 65, and the unbalanced-type output terminal 39 is electrically connected to the mixer 67 on the receiving side. That is, since the isolator 21*a* can input signals having a phase difference of 180 degrees at the same amplitude to the balanced-type input terminals 37 and 38, the isolator 21*a* can be connected to the balanced-type output terminal of the Surface-Acoustic-Wave band-pass filter 65. Therefore, it is possible to obtain a small and low-cost portable phone 51*a* having a low insertion loss and low unwanted radiation.

Figure 7:
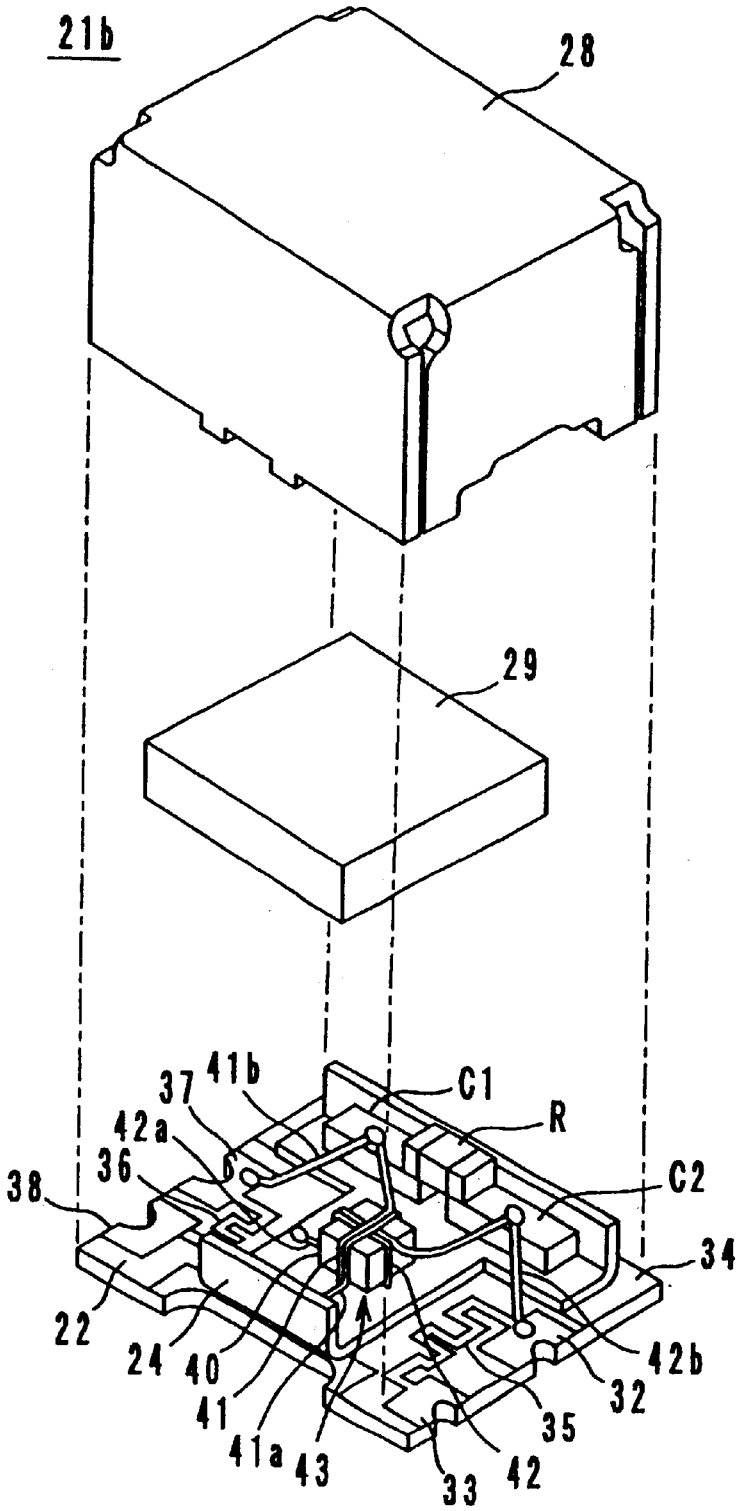
FIG. 7 is an exploded perspective view showing a third embodiment of a nonreciprocal circuit device according to the present invention.
Figure 8:
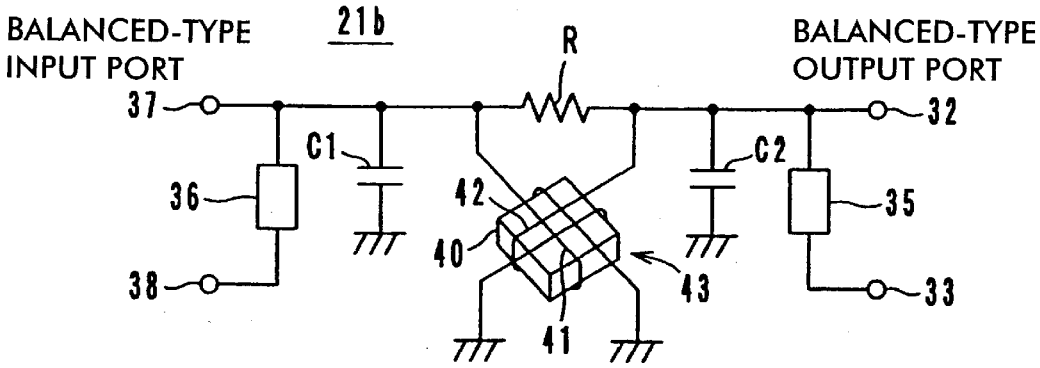
FIG. 8 is an electrical-equivalent circuit diagram of the nonreciprocal circuit device shown in FIG. 7.
Figure 9:
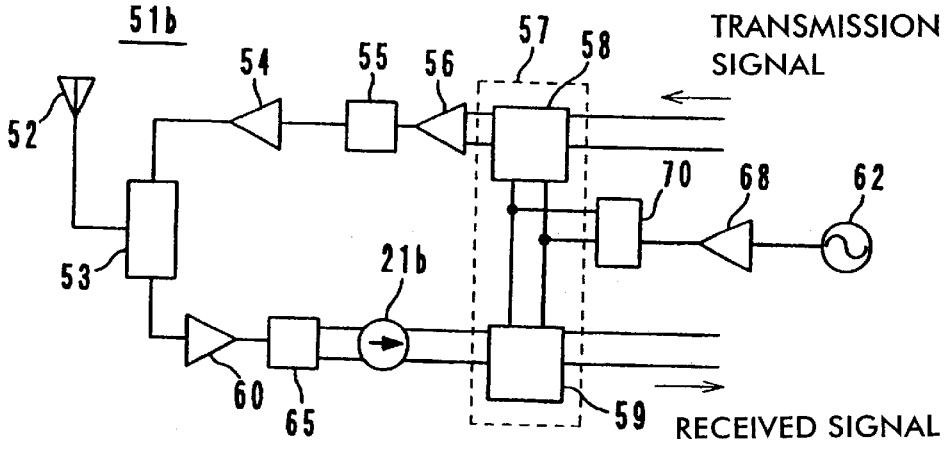
FIG. 9 is an electrical block diagram of a communication device comprising the nonreciprocal circuit device shown in FIG. 7.

[Third Embodiment, FIGS. 7 to 9]

As shown in FIGS. 7 and 8, in an isolator 21*b* of the third embodiment, the input port is formed by a pair of balanced-type input terminals 37 and 38, and the output port is also formed by a pair of balanced-type output terminals 32 and 33.

The balanced-type input terminals 37 and 38, the balanced-type output terminals 32 and 33, the grounding terminal 34, and the half-wave lines 35 and 36 are formed on the circuit board 22. Meandering half-wave lines 36 and 35 are electrically connected to create a phase difference is 180 degrees at an intended operating frequency between the balanced-type input terminals 37 and 38 and between the balanced-type output terminals 32 and 33, respectively.

Then, the end portion 41*b* of the center electrode 41 of the center electrode assembly 43 is soldered to the capacitor electrode on the hot side of the matching capacitor C1, and, thereafter, the end portion 41*b* is soldered to the balanced-type input terminal 37. Similarly, the end portion 42*b* of the center electrode 42 is soldered to the capacitor electrode on the hot side of the matching capacitor C2, and, thereafter, the end portion 42*b* is soldered to the balanced-type output terminal 32.

FIG. 9 is an electrical-circuit block diagram showing a circuit in which the isolator 21*b* is incorporated in a portable phone 51*b* which uses a direct conversion modulation method. In FIG. 9, reference numeral 52 denotes an antenna element. reference numeral 53 denotes a duplexer. reference numerals 54 and 56 each denote a power amplifier on the transmission side. reference numeral 55 denotes an interstage band-pass filter on the transmission side. Reference numeral 57 denotes an IC in which a modulator 58 and a demodulator 59 are incorporated. Reference numeral 60 denotes a low-noise amplifier on the receiving side. Reference numeral 65 denotes a surface-acoustic-wave band-pass filter. Reference numeral 70 denotes a balun. Reference numeral 68 denotes a buffer amplifier. Reference numeral 62 denotes a voltage-controlled oscillator.

The isolator 21*b* is formed such that the balanced-type input terminals 37 and 38 thereof are electrically connected to the surface-acoustic-wave band-pass filter 65 without going through a balun, and that the balanced-type output terminals 32 and 33 thereof are electrically connected to the IC 57. Therefore, it is possible to obtain a small and low-cost portable phone 51*b* having a low insertion loss and low unwanted radiation.

Figure 10:
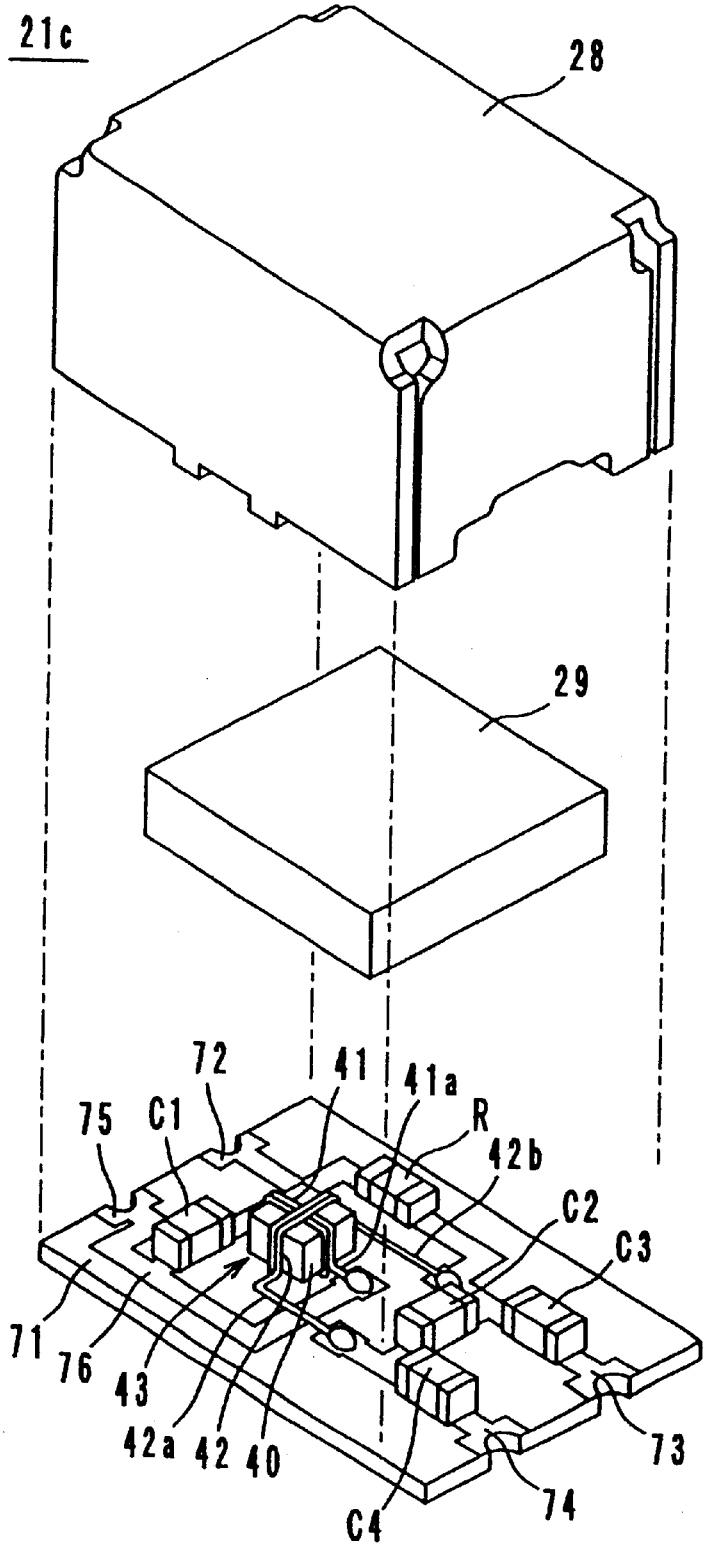
FIG. 10 is an exploded perspective view showing a fourth embodiment of a nonreciprocal circuit device according to the present invention.
Figure 11:
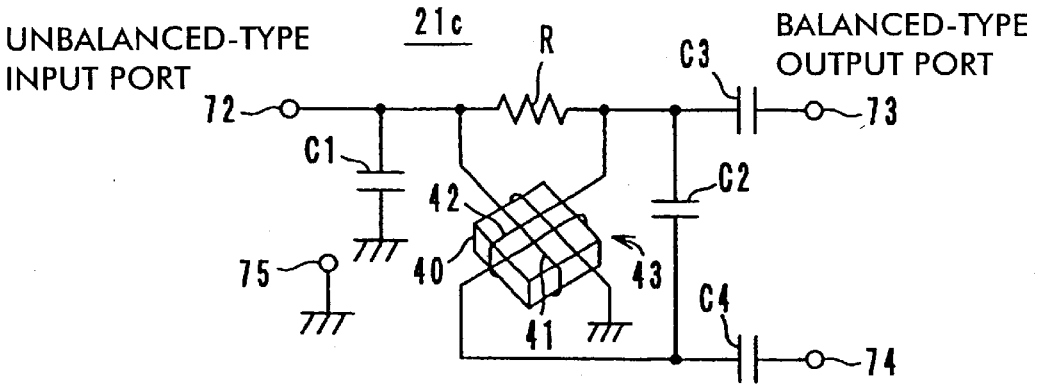
FIG. 11 is an electrical-equivalent circuit diagram of the nonreciprocal circuit device shown in FIG. 10.

[Fourth Embodiment, FIGS. 10 and 11]

As shown in FIGS. 10 and 11, in an isolator 21*c* of the fourth embodiment, the input port is formed by an unbalanced-type input terminal 72 and the output port is formed by balanced-type output terminals 73 and 74.

The unbalanced-type input terminal 72, the balanced-type output terminal 73 and 74, a grounding terminal 75, and a circuit pattern 76 are formed on a circuit board 71. Both the unbalanced-type input terminal 72 and the grounding terminal 75 are exposed on the left side of the circuit board 71, and the pair of balanced-type output terminal 73 and 74 are exposed on the right side thereof. Both ends 42*a* and 42*b* of the center electrode 42 of the center electrode assembly 43 are electrically connected to the balanced-type output terminal 74 and 73 via matching capacitors C4 and C3, respectively. Furthermore, both ends 42*a* and 42*b* of the center electrode 42, which are electrically connected to the balanced-type output terminal 74 and 73, are electrically connected to each other through the matching capacitor C2. One end 41 a of the center electrode 41 is electrically connected to the grounding terminal 75, and the other end 41*b* (not shown in FIG. 10) is electrically connected to the grounding terminal 75 via the matching capacitor C1. Furthermore, one end of the resistor R is electrically connected to the matching capacitor C1 and one end 41*b* of the center electrode 41, and the other end thereof is electrically connected to the matching capacitors C2 and C3 and the other end 42*b* of the center electrode 42.

The input port of this isolator 21*c* is formed by an unbalanced-type input terminal 72, and the output port is formed by a pair of balanced-type output terminals 73 and 74. That is, since the isolator 21*c* can output signals with a phase difference of 180 degrees at the same amplitude from the balanced-type output terminals 73 and 74, the isolator 21*c* can be electrically connected to a device having balanced-type input terminals without going through a balun. Moreover, in this isolator 21*c*, since a balanced-type output port is formed by connecting two capacitors C3 and C4, the size thereof can be reduced even further than the isolator 1 of the first embodiment using the half-wave line 35.

Figure 12:
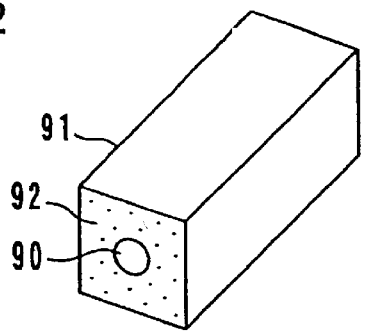
FIG. 12 is a perspective view showing a coaxial line.
Figure 13:
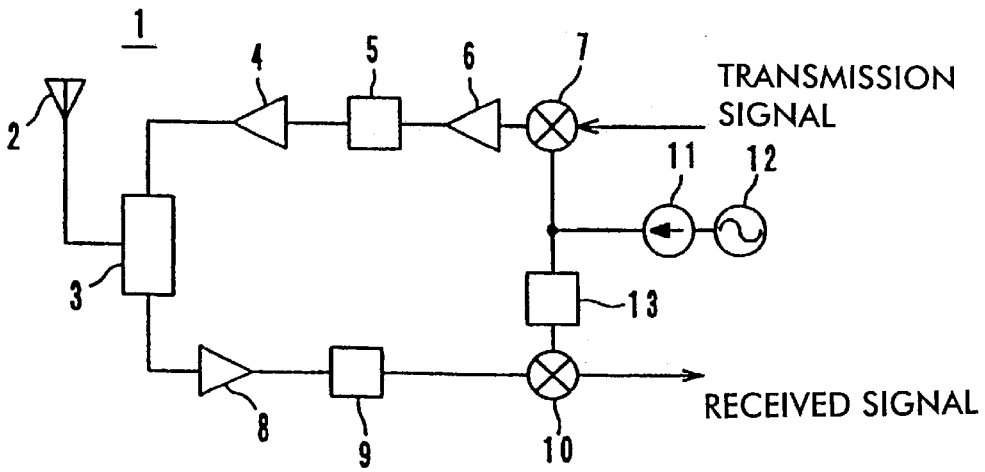
FIG. 13 PRIOR ART
FIG. 13 is an electrical block diagram of a communication device comprising a conventional nonreciprocal circuit device.

The nonreciprocal circuit device and the communication device according to the present invention are not limited to the above-described embodiments, and can be variously changed within the spirit and scope thereof. For example, instead of the half-wave line, as shown in FIG. 12, a coaxial line formed of an internal conductor 90 and an external conductor 91, in which a dielectric 92 is held in between, may be used.

Furthermore, the center electrode, the matching capacitor, etc., may be formed on the surface of a dielectric substrate or a magnetic substrate by a method such as pattern printing, or may be formed by a method such as pattern printing inside a multilayered substrate which is formed by laminating dielectric sheets or magnetic sheets. When a center electrode is formed on the magnetic substrate or on the magnetic multilayered substrate formed by laminating dielectric sheets, a construction in which ferrite and the center electrode are integrally formed can be obtained.

As is clear from the above description, according to the present invention, since at least one of two ports is a balanced-type port, the nonreciprocal circuit device can be connected to a device having a balanced-type terminal without going through a balun. As a result, the manufacturing cost, insertion loss, and unwanted radiation can be reduced, and a small communication device having superior frequency characteristics can be obtained.

While the present invention has been described with reference to what is presently considered to be the best mode of practicing the invention, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A nonreciprocal circuit device comprising only two ports, wherein one port of said two ports is an input port and the other port of said two ports is an output port, and at least one of said two ports is a balanced port.

2. A nonreciprocal circuit device according to claim 1, wherein the input port is an unbalanced port, and the output port is a balanced port.

3. A nonreciprocal circuit device according to claim 1, wherein the input port is a balanced port, and the output port is an unbalanced port.

4. A nonreciprocal circuit device according to claim 1, wherein the input port and the output port are balanced ports.

5. A nonreciprocal circuit device according to claim 1, wherein said balanced port comprises a pair of terminals which are electrically connected to respective ends of a line which is substantially a half-wave in length at an operating frequency.

6. A nonreciprocal circuit device according to claim 1, further comprising: a center electrode assembly formed of a ferrite and two center electrodes, a permanent magnet for applying a DC magnetic-field to said ferrite, and a metal case for housing said center electrode assembly and said permanent magnet, wherein said balanced port comprises a pair of terminals which are electrically connected to respective ends of a line which is substantially a half-wave in length at an operating frequency, and one of said pair of terminals is electrically connected to one of said center electrodes.

7. A nonreciprocal circuit device according to claim 1, further comprising: a center electrode assembly formed of a ferrite and two center electrodes, a permanent magnet for applying a DC magnetic-field to said ferrite, and a metal case for housing said center electrode assembly and said permanent magnet, wherein said balanced port comprises a pair of terminals which are each electrically connected to a respective end of one of said center electrodes via a corresponding matching capacitor.

8. A communication device comprising at least one of a transmitting circuit and a receiving circuit, and connected to said circuit, a nonreciprocal circuit device according to claim 1.

* * * * *